United States Patent [19]

Gerry

[11] 4,123,689

[45] Oct. 31, 1978

[54] TRANSIENT INTERMODULATION IGNITION SYSTEM

[76] Inventor: Martin E. Gerry, 13452 Winthrope St., Santa Ana, Calif. 92705

[21] Appl. No.: 814,456

[22] Filed: Jul. 11, 1977

[51] Int. Cl.[2] ..... H05B 37/02; H05B 39/04; H05B 41/36

[52] U.S. Cl. ..... 315/209 R; 123/148 AC; 123/148 E; 315/172; 315/176; 315/213

[58] Field of Search ..... 315/209 R, 209 T, 209 M, 315/213, 172, 214, 176, 215, 216, 170, 171, 209 CD, 166, 167; 307/164; 123/148 AC, 148 E, 148 DC, 146.5 B; 361/253, 263; 332/8

[56] References Cited

U.S. PATENT DOCUMENTS

| | | | |
|---|---|---|---|
| 2,380,707 | 7/1945 | Sawyer | 315/213 X |
| 2,819,428 | 1/1958 | Bowlus et al. | 315/226 X |
| 3,906,919 | 9/1975 | Asik et al. | 123/148 E |
| 3,972,315 | 8/1976 | Munden et al. | 123/148 E |
| 4,033,316 | 7/1977 | Birchenough | 315/176 |

*Primary Examiner*—Saxfield Chatmon, Jr.

[57] ABSTRACT

A high energy ignition system makes use of induced transient voltages in an ignition transformer to intermodulate a plural number of such transients and thereby provide extremely high voltages to fire an igniter. The transformer output is connected in conventional manner to a standard distributor to sequentially energize igniters.

9 Claims, 9 Drawing Figures

TRANSIENT INTERMODULATION IGNITION SYSTEM

RELATED APPLICATIONS

This application is related to one entitled: Transient Modulation Ignition System, by same inventor, Ser. No. 812,985, filed July 5, 1977.

INCORPORATION BY REFERENCE

This application incorporates by reference a set of computations, concurrently filed, deriving the mathematical terms and graphs herein as though fully set forth in the specification text.

BACKGROUND OF THE INVENTION

This invention is in the field of ignition systems and particularly wherein induced transient voltages of typical Kettering type are intermodulated to increase energy levels and also to provide multiple high energy level waveforms.

Prior art systems do not provide a reliable, simple and inexpensive timing means, and generally do not provide intermodulation principles.

Prior art systems also have need of an ignition transformer which has a high secondary to primary turns ratio in order to deliver the required pre-firing voltage to the igniters. These types of systems attenuate the current levels of the firing arc in the process of transfering voltages from the primary to the secondary winding.

SUMMARY OF THE INVENTION

Accordingly it is an objective of this invention to utilize passive circuit elements in such a way so as to produce high energy levels of induced voltages in the ignition transformer.

It is another objective of this invention to intermodulate a plurality of Kettering type transient voltages so that the effective induced voltage waveforms in the ignition transformer are extremely high and thereby act to more thoroughly ignite the fuel within an engine.

Another objective is to provide a simple, reliable and inexpensive timing device used in part of the ignition system.

Still another objective is to use an ignition transformer with a low turns ratio having a high secondary current delivery capability, and hence increase the current levels in the firing arcs of the igniters thereby delivering high voltage levels to the igniters at the same time as delivering the increased current levels.

Hence the ignition system is mechanized, having electrical igniters and producing a plural number of transient signals during firing period of any one of the igniters. Means are provided for initiating each of the transient signals in predetermined order, and an ignition transformer is provided having a single primary winding, electrically connected to the means, for intermodulating a plural number of the initiated transient signals.

Such means includes first means for providing predetermined spacing between the transient signals. Such means also includes second means for timing such transient signals. Such means also includes third means for providing DC power to the ignition transformer during operative mode of the system.

Said means includes a switching subsystem electrically coupled to the primary winding of the transformer. The subsystem includes timing means which is intermittently electrically coupled to the primary winding. The timing means may be an electrically conductive timing wheel, driven during operative mode of the system, and having electrically insulating members regularly spaced at the periphery of the timing wheel.

A plural number of electrical contactors, regulary spaced about the periphery of the timing wheel, and cooperating with said periphery, is provided. A capacitor is electrically connected to each of the electrical contactors, one capacitor per contactor. Alternately, a capacitor in series with a first inductor may be provided in lieu of the capacitor by itself. The capacitor is electrically connected to each of the electrical contactors wherein one combination capacitor and series inductor is provided per contactor. A resistor electrically connected intermediate each of the contactors and the primary winding is provided. A second inductor electrically connected intermediate each of the contactors and the primary winding may be provided in lieu of the resistor. The first inductor has two ends, one of these ends being connected to the capacitor and the other of the ends to positive DC provided by the battery.

DETAILED DESCRIPTION

Figure 1:
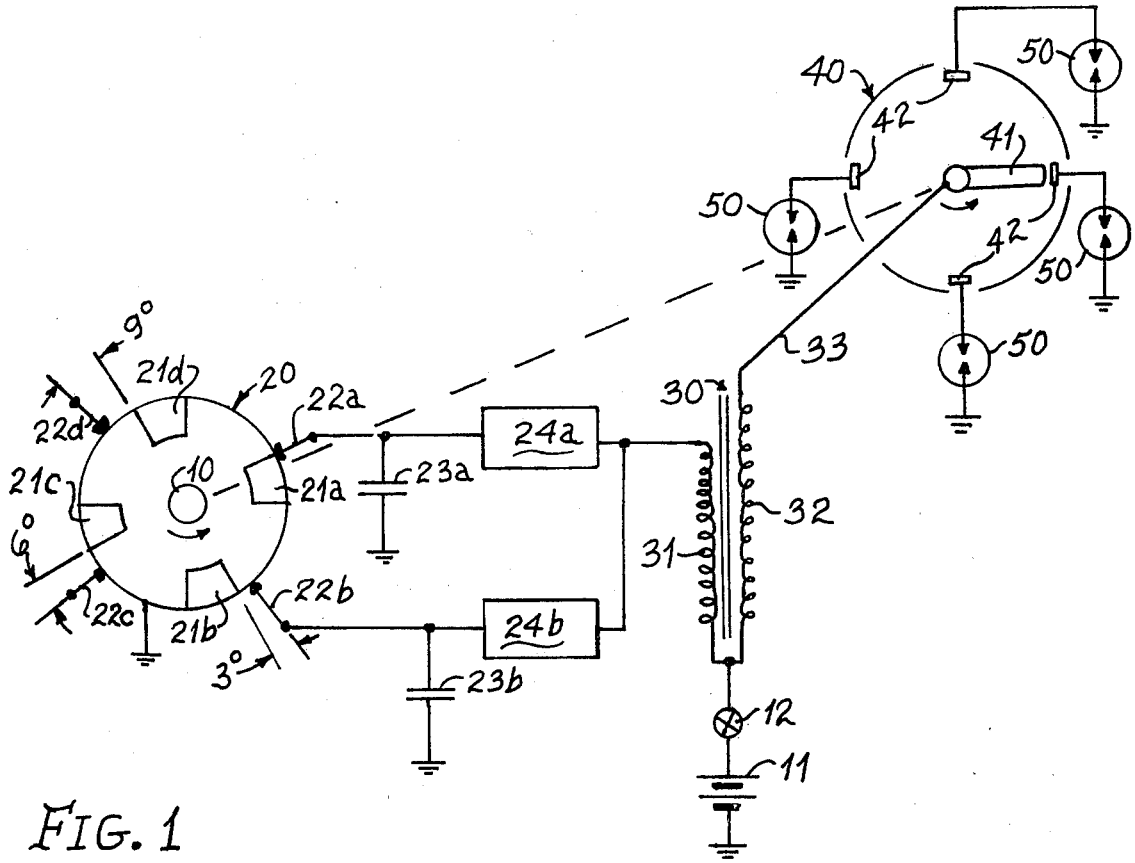
FIG. 1 is an electro-mechanical schematic of the system according to the invention.

Referring to FIGS. 1, 1*a*, 2 and 2*a*, a schematic circuit is provided for the operation of the invention including equivalent circuits thereof from which analysis of the system was made.

An engine drives distributor shaft 10 which has mounted thereon a timing wheel coupled to the distributor rotor, both being driven in counterclockwise direction as shown by the arrows.

Timing wheel 20 is made of metallic or electrically conductive material so that by virtue of being mounted on grounded shaft 10, the wheel is capable of providing intermittent ground potentials while being driven. The wheel, except for insert members 21*a*–21*d*, is therefore at ground or battery negative potential. Throughout this description the conventional ground symbol is used to indicate negative battery potential and a common electrical return path, so that no reference will be made to such return path hereinbelow.

Wheel 20 has electrically insulating member inserts 21*a*–21*d* regularly spaced, in this instance every 90° since the illustration shows a four cylinder ignition system. It is understood that for each cylinder and its igniter one such insulating member will be provided, so that a six cylinder ignition system will have a timing wheel with six inserts spaced every 60°, and an eight cylinder ignition system will have eight inserts spaced every 45°. These inserts are molded to the metal of the wheel or otherwise permanently mechanically affixed thereto.

Electrically conductive contactor 22a is shown positioned at the leading edge of insert 21a, and such contactor is in electrical cooperation with the periphery of disk 20 and the peripheries of its inserts. Electrically conductive contactor 22b is shown positioned 3° before the leading edge of insert 21b and is also in cooperation with the disk and insert peripheries. Similarly in cooperation with the disk and insert peripheries are contactors 22c and 22d. Contactor 22c is shown as positioned 6° before the leading edge of insert 21c and contactor 22d is shown at 9° before the leading edge of insert 21d.

A minimum of two contactors such as 22a and 22b need be used in the system, and additional contactors 22c and/or 22d are used to increase further the intermodulation energy levels provided by the system. In such case, additional circuits consisting of components 23a–24a or 23a–25 are similarly connected between these contactors and input to transformer 30 at 31.

Figure 1A:
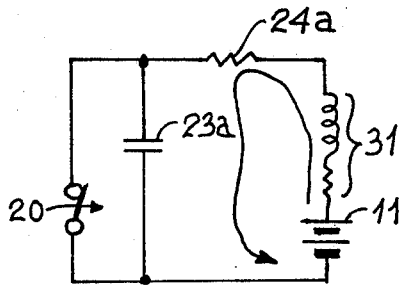
FIG. 1*a* is an equivalent circuit of a portion of the schematic of FIG. 1.
Figure 2:
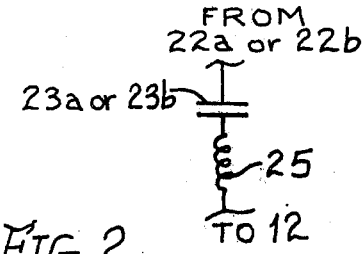
FIG. 2 shows an electrical pair of components used to substitute for capacitors as shown in FIG. 1.
Figure 2A:
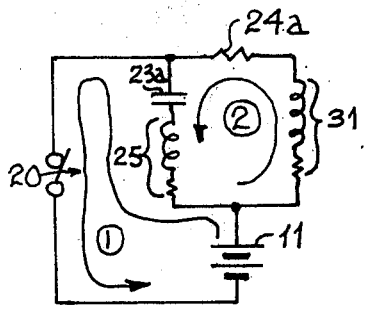
FIG. 2*a* is an equivalent circuit of a portion of the schematic of FIG. 1 when components of FIG. 2 are used therein.

Accordingly, when disk 20 is driven by the engine, and when contactor 22a, for example, is intermediate inserts 21d and 21a, capacitor 23a is short circuited by virtue of ground potential applied to contactor 22a, thus charging primary winding 31 of transformer 30 through either resistor or inductor at 24a. Capacitor 23a may be replaced by a combination of capacitor 23a in series with an inductor 25 and in such case the return path of inductor 25 may be connected to ignition switch 12 which is at positive battery potential. An equivalent circuit for the use of only a capacitor as at 23a is shown in FIG. 1a resulting in one current path depicted by an arrow during charge and discharge modes of the system. Another equivalent circuit is shown in FIG. 2a, showing two current paths when the combination of capacitor 23a and inductor 25 is used and wherein the return leg of inductor 25 is connected to positive battery terminal of battery 11 through ignition switch 12. Of course it is understood that the return leg of inductor 25 may be connected to ground, in which case an equivalent circuit such as shown in FIG. 1a will obtain except that in such equivalent circuit capacitor 23a will be replaced by capacitor 23a in series with inductor 25.

When wheel 20 is driven so that contactor 22a is in cooperation with the periphery of insert 21a only, ground is removed from across capacitor 23a, which action is analogous to opening a switch as shown at 20 in FIG. 1a and permitting a transient current to flow from the intermittenly charged inductor 31, through capacitor 23a, providing an induced voltage in primary 31 according to Faraday's law of induction. Energy will continue to be delivered during firing period of one igniter in accordance with the functions shown in FIGS. 3–7 to be hereinbelow discussed, and will cease to be delivered after disk 20 has been rotated so that contactor 22a is past the lagging edge of insert 21a.

After 3° of disk 20 rotation, contactor 22b, previously short circuiting capacitor 23b, because of its ground potential, will be positioned at the leading edge of insert 21b to remove the short circuit from across capacitor 23b, at which time contactor 22a will be located 3° within the confines of insert 21a and past its leading edge in cooperation with such insert periphery. Thus, inductor primary 31 will, through resistor or combination of resitor and inductor 24b, deliver another burst of energy, similar in character to the first burst, during the period of firing of the same one igniter.

If desired, similar circuits as indicated by combinations 23a–24a or 25–24a may be used, connected between primary 31 and contactors 22c and/or 22d respectively to obtain three or four intermodulating waves instead of two during the same firing period of the same one igniter, since contactor 22c will provide one waveform at 6° after contactor 22a is positioned relative the leading edge of insert 21a, and contactor 22d will provide another waveform 9° after contactor 22a is positioned relative the leading edge of insert 21a. Since inserts 21a–21d need only be 12° in arc length at their outer peripheries for any disks 20 used in connection with 4, 6 or 8 cylinder systems, the firing period of each igniter can be provided with four intermodulated waveforms to increase the voltage induced in primary 31, though it is apparant that only two waveforms will induce a very substantial composite transient intermodulated voltage in such primary winding.

Amplitude intermodulation of each transient signal is possible by virtue of transformer 30 and winding 31 thereof exhibiting non-linear characteristics, needed to obtain amplitude modulation of any two waveforms as provided, for example by circuits 23a–24a and 23b–24b.

Figure 3:
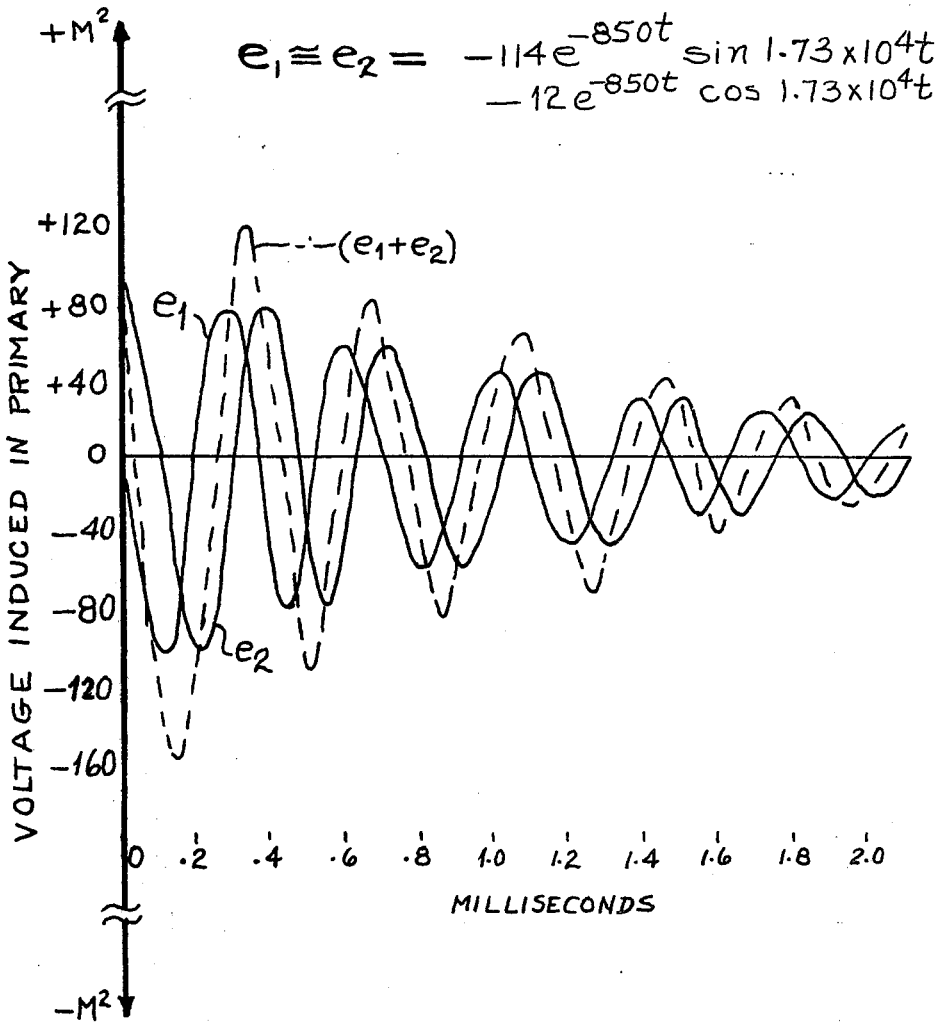
FIG. 3 is a graph of computed induced voltages in an ignition transformer.
Figure 4:
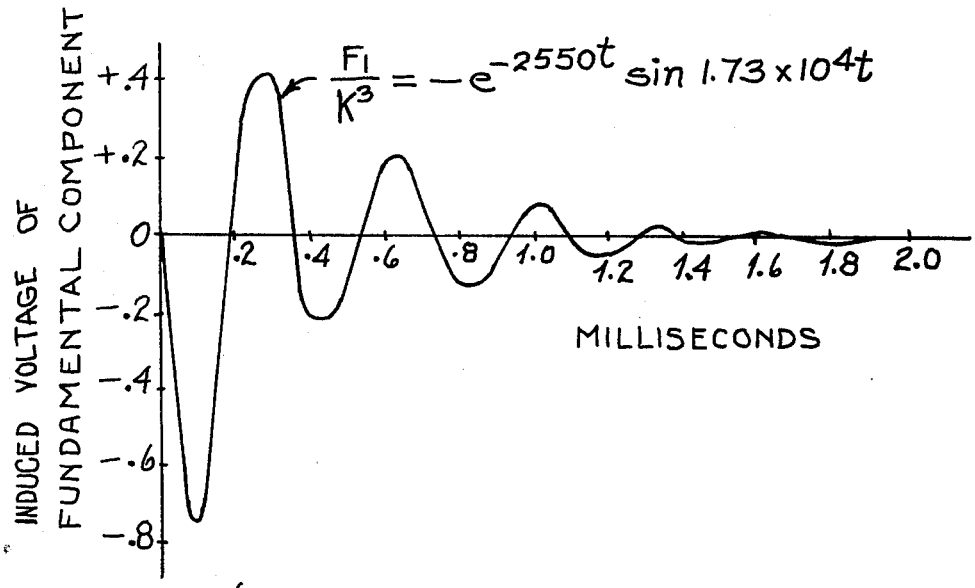
FIGS. 4–7 are graphs of computed intermodulation products of the induced voltages shown in FIG. 3.
Figure 5:
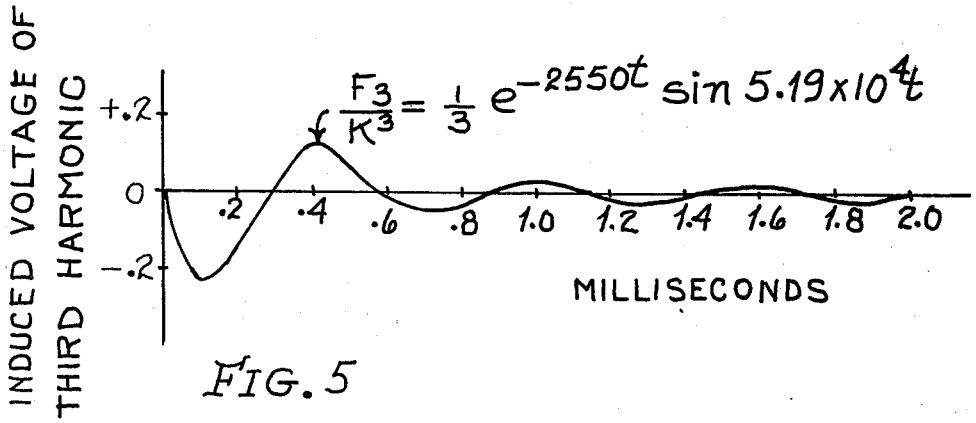

Referring to FIG. 3, one of the voltages, $e_1$ which is equal to $e_2$, except for a 3° degree phase shift, is derived by the use of Laplace transform methods, utilizing typical parameters of primary 31, a value of 0.5 microfarads for capacitor 23a, and a value of 10 ohms for resistor at 24. The other identical wave $e_2$ is graphed with a three degree phase shift, so that the two waves $(e_1 + e_2)$ may be graphically summed as indicated by the dashed line curve, to obtain a physical indication of an increase in induced voltage obtainable by intermodulation. This graph however does not reflect the true situation, as the indicated voltage excursions due to intermodulation will swing to a maximum of $\pm M^2$, wherein $M^2$ is symbolic of the maximum amplitudes obtained principally in the squared term of the expansion of an infinite series describing amplitude modulation, to wit:

$$e_{mod} = [e_1 + e_2] + 1/2![e_1 + e_2]^2 + 1/3![e_1 + e_2]^3 \quad (1)$$

wherein such expansion will result in the intermodulation components or cross products hereinbelow shown in connection with FIGS. 4–7.

Referring again to FIGS. 1 and 2, DC power from battery 11 is provided through ignition switch 12 to feed primary winding 31, which power provides the charge of primary 31 and initial voltage condition therein during the modes when contactors 22a–22d are respectively at ground potential. In the case where capacitor 23a has inductor 25 in series therewith, per equivalent circuit of FIG. 2a, it can be seen that during the charge period, when the contactors are at ground potential, that all components including primary 31, capacitor 23a and series inductor 25 will have established initial conditions, the initial charge in inductor 25 offsetting and providing additional input circuit voltage notwithstanding the undesired initial charge of capacitor 23a which tends to decrease such initial input voltage. Thus a slight advantage will be obtained utilizing inductor 25 in series with capacitor 23a for example, and similarly for the other like circuits.

The disadvantage of contact bounce in conventional ignition contactors or points disappears when using disk 20 and its contactor combination since only a sliding action is involved. Such contactors may have a spring steel shank or be made of beryllium copper material.

Thus an inexpensive and reliable timing means is provided which precludes the need for expensive light emitting or magnetic pulse switch subsystems or even more expensive computer substitutes.

Figure 6:
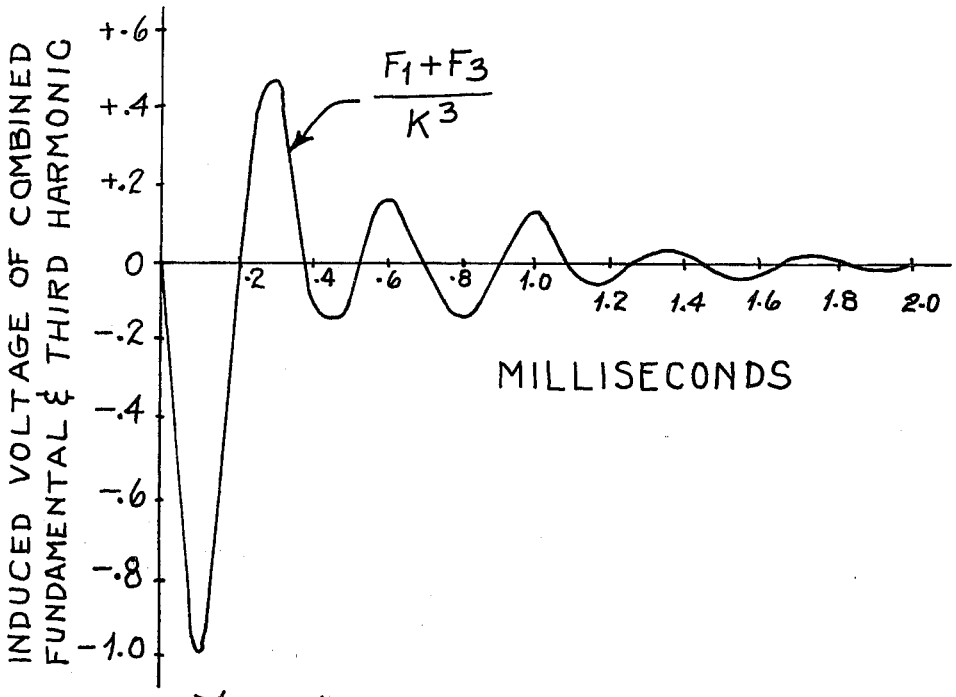
Figure 7:
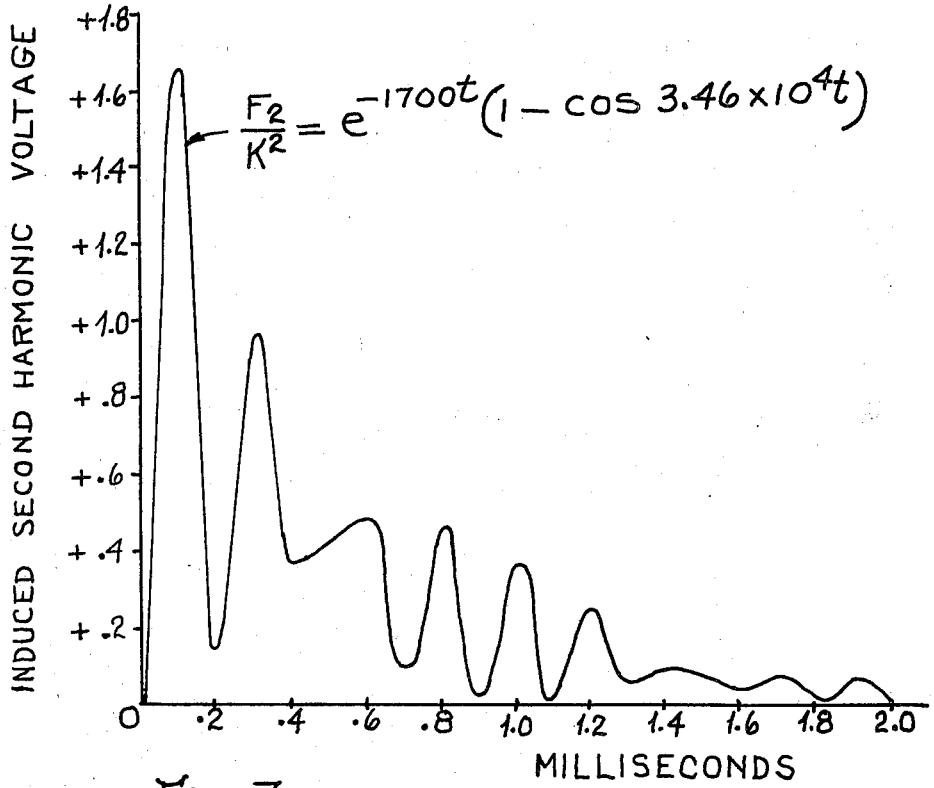

The intermodulated induced voltage, as per FIG. 6, will be transferred from primary 31 to secondary 32 of transformer 30 during the firing period of any one igniter 50 when rotor 41 electrically connected to secondary 32 by wire 33 will cause an arc supported by high voltage between rotor 41 and stator member 42 of distributor 40 to fire igniter 50. The ignition period will be repeated in similar manner for the next-in-sequence igniter 50 at which time wheel 20 and rotor 41 will have advanced counterclockwise so that contactor 22*a* will be positioned at the beginning of the next ignition cycle at the leading edge of insert 21*b*. The action will continue in like manner until all igniters are fired and contactor 22*a* is again opposite the leading edge of insert 21*a*.

FIGS. 4–7 were obtained by using the dominant term of the function shown in FIG. 3, and expanding same in the converging infinite series (1) to obtain:

$$e_{mod} = -K^3 e^{-2550t} \sin 1.73 \times 10^4 t + K^2 e^{-1700t}[1 - \cos 3.46 \times 10^4 t] + K^3/3\, e^{-2550t} \sin 5.19 \times 10^4 t \quad (2)$$

the terms of which represent respectively the fundamental frequency component of $1.73 \times 10^4$ radians/-second, the second harmonic of $3.46 \times 10^4$ radians/-second, and the third harmonic of $5.19 \times 10^4$ radians/-second.

The amplitudes of the fundamental and third harmonic components being a power of ten greater than the amplitude of the second harmonic, it was possible to graph the fundamental and third harmonics in one composite waveform as shown in FIG. 6. The fundamental and third harmonic waveforms independently are respectively shown in FIGS. 4 and 5. The functions herein are rationalized with respect $K^3$ for the fundamental and third harmonic components, and with respect to $K^2$ for the second harmonic component, wherein $K = 114$. Hence, the second harmonic component is trivial in effect upon composite of FIG. 6 and injecting such component in FIG. 6 curve would not visibly alter the curve characteristics. Hence, one can deduce that second and higher order even harmonics can be disregarded. Also higher order odd harmonic terms can also be expected to have minimal effect upon FIG. 6 characteristics and can be disregarded for the ignition intermodulation purpose.

Accordingly, it is seen that the voltage induced due to intermodulation of two similar transient signals produced by the system may be represented by the waveform of FIG. 6. Such being the case, firing periods in excess of one millisecond will not vary the energy level to the igniters significantly, and for the most part adequate switching action can be readily accomplished in a period of only 0.4 milliseconds, substantial attenuation of the composite waveform resulting thereafter.

Advantages over related invention, hereinabove referred to, is the freedom from need of multiple ignition primary windings in an ignition transformer, as well as the possibility of utilizing a transformer with reduced turns ratio between secondary and primary, enabling increase in secondary or firing current while substantially maintaining a high secondary voltage. Other advantages include extreme simplicity in the overall circuit and particularly in the timing means.

What is claimed is:

1. An ignition system having electrical igniters and producing a plural number of transient signals during firing period of any one of the igniters, comprising the combination of:

a timer, driven during operative mode of the system, having a plural number of electrical contactors coupled thereto;

an electrical circuit, composed of passive components only, connected to each of the contactors, one said circuit per contactor; and an ignition transformer having a primary winding, said primary winding being electrically connected to all of the electrical circuits.

2. The invention as stated in claim 1, wherein said timer is an electrically conductive timing wheel having electrically insulating members regularly spaced at the periphery thereof.

3. The invention as stated in claim 2, wherein said electrical contactors are regularly spaced about the periphery of the timing wheel and in cooperation with said periphery.

4. The invention as stated in claim 3, wherein each said electrical circuit comprises a capacitor connected to its respective contactor.

5. The invention as stated in claim 3, wherein each said electrical circuit includes a capacitor in series with an inductor, said capacitor being electrically connected to its respective contactor, one said capacitor and inductor per contactor.

6. The invention as stated in claim 3, wherein each said electrical circuit includes a resistor electrically connected intermediate one of the contactors and the primary winding, one said resistor per contactor connection.

7. The invention as stated in claim 5, wherein said inductor has two ends, one of said ends being connected to the capacitor and the other of said ends being at positive DC potential.

8. An ignition method producing a plural member of transient signals during firing period of any one of a plurality of electrical igniters, comprising in combination the steps of:

energizing a primary winding of an ignition transformer with each of said signals in generation sequence of said signals;

intermodulating said signals within said transformer thereby producing an intermodulated transient voltage in said primary winding; and inducing the intermodulated transient voltage in a secondary winding of said transformer thereby firing one of said igniters with the induced intermodulated transient voltage.

9. The method as stated in claim 8, wherein the step of energizing includes the step of timing the initiation of said signals at predetermined angular intervals of a driven timing means.

* * * * *